US008087809B2

(12) United States Patent
Tikhman et al.

(10) Patent No.: US 8,087,809 B2
(45) Date of Patent: Jan. 3, 2012

(54) APPARATUS FOR ILLUMINATING BRAND IN A BOTTLE AND METHOD FOR THE SAME

(75) Inventors: Simon Tikhman, Hillsborough, CA (US); Anatoly Tikhman, Hillsborough, CA (US); Michael Kapgan, Foster City, CA (US)

(73) Assignee: Simont Enterprises, LLC, West Hollywood, CA (US)

( * ) Notice: Subject to any disclaimer, the term of this patent is extended or adjusted under 35 U.S.C. 154(b) by 361 days.

(21) Appl. No.: 12/146,441

(22) Filed: Jun. 25, 2008

(65) Prior Publication Data

US 2009/0321375 A1 Dec. 31, 2009

(51) Int. Cl.
*F21V 8/00* (2006.01)

(52) U.S. Cl. ..... 362/555; 362/101

(58) Field of Classification Search ..... 362/555, 362/101, 565, 581; 211/74
See application file for complete search history.

(56) References Cited

U.S. PATENT DOCUMENTS

| | | | | |
|---|---|---|---|---|
| 5,941,381 | A * | 8/1999 | James | 206/229 |
| 6,474,858 | B1 * | 11/2002 | Liao | 362/551 |
| 6,836,065 | B2 * | 12/2004 | Chow | 313/485 |
| 7,703,226 | B2 * | 4/2010 | Schnuckle | 40/310 |
| 7,771,073 | B2 * | 8/2010 | Chen | 362/101 |
| 2004/0218402 | A1 * | 11/2004 | Jao | 362/555 |
| 2007/0201220 | A1 | 8/2007 | Ulicny | |

* cited by examiner

*Primary Examiner* — Sharon Payne
(74) *Attorney, Agent, or Firm* — Joe Zheng

(57) ABSTRACT

Designs of bottle sets are disclosed to highlight a sign in a transparent container. In one embodiment, a bottle set includes a bottle and a base. A fixture is provided and disposed within the bottle. The fixture includes a light guide extended from an interior bottom of the bottle. The bottle is positioned onto the base, where the base provides a light source lighting of which is guided through the light guide to shine the mark on the fixture.

20 Claims, 5 Drawing Sheets

APPARATUS FOR ILLUMINATING BRAND IN A BOTTLE AND METHOD FOR THE SAME

BACKGROUND

1. Technical Field

The present invention is generally related to the area of wine display. Particularly, the present invention is related to bottle designs of highlighting a sign in a transparent container. More specifically, the present invention is related to designs of highlighting a brand in a wine bottle.

2. Description of the Related Art

A wine bottle is a bottle used for holding wine, generally made of glass. Some wines are fermented in the bottle, others are bottled only after fermentation. They come in a large variety of sizes. The standard bottle contains 750 mL, although this is a relatively recent development. Wine bottles are usually sealed with cork, but screw-top caps are becoming popular, and there are several other methods used to seal a bottle.

After a wine bottle is done, a label designed in various fashions, is put on the bottle. The label is often the only resource a buyer has for evaluating the wine before purchasing it. Certain information is always included in the wine label, such as the country of origin, quality, type of wine, alcoholic degree, producer, bottler, or importer. Some wineries place great importance on the label design while others do not. There are wineries that have not changed their label's design for many years, while others hire designers every year to change it. The elegance of a label does not determine the quality of wine in the bottle but may attract the attention of a consumer, possibly creating a purchase desire towards the wine.

No matter how the label is designed, the variations are being repeated or limited. An elegant design of a label together with a bottle may lose its elegance among many bottles of wine in a display rack.

There is a need for other types of bottle designs that go beyond the traditional label designs and attract the attention of consumers while being displayed.

SUMMARY

This section is for the purpose of summarizing some aspects of embodiments of the present invention and to briefly introduce some preferred embodiments. Simplifications or omissions in this section as well as in the title and the abstract of this disclosure may be made to avoid obscuring the purpose of the section, the title and the abstract. Such simplifications or omissions are not intended to limit the scope of the present invention.

Broadly speaking, the present invention is related to bottle designs of highlighting a sign in a transparent container. According to one aspect of the present invention, the present invention is related to designs of highlighting a mark or marks in a wine bottle (e.g., a vodka bottle). A fixture is provided and disposed within the bottle. The fixture includes a light guide extended from an interior bottom of the bottle. The bottle is positioned onto the base, where the base provides a light source lighting of which is guided through the light guide to shine the mark on the fixture.

According to another aspect of the present invention, the mark(s) are pre-distorted to compensate visual distortion through a glass bottle and/or liquid content in the bottle. The mark(s) are imprinted, itched and marked on the fixture. With the illumination provided in the light guide, the mark(s) are shined or highlighted. As a result, a bottle set designed in accordance with one embodiment of the present invention stands out with illuminated marks or brand names among all displays, considerably attracting attentions from shoppers or visitors.

Embodiments of the invention may be implemented in numerous ways, including a method, a bottle set, or a part of a display system. According to one embodiment, the present invention is a bottle set comprising: a base including a light source to provide illumination; a bottle being fit onto the base; and an elongated fixture disposed in a central position with the bottle, wherein the fixture includes a light guide to collect the illumination and shine a mark on the fixture.

According to another embodiment, the present invention is a method for a bottle set including a bottle and a base, the method comprises providing a fixture in a bottle, wherein the fixture including a light guide is extended from an interior bottom of the bottle; and sitting the bottle onto the base, wherein the base provides a light source lighting of which is guided through the light guide to shine a mark on the fixture.

There are numerous objects, features, and advantages in the present invention. These objects, features, and advantages will become apparent upon examining the following detailed description of various embodiments thereof, taken in conjunction with the attached drawings.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

In the following description, numerous specific details are set forth in order to provide a thorough understanding of the present invention. However, it will become obvious to those skilled in the art that the present invention may be practiced without these specific details. The descriptions and representations herein are the common means used by those experienced or skilled in the art to most effectively convey the substance of their work to others skilled in the art. In other instances, well-known components have not been described in detail to avoid unnecessarily obscuring aspects of the present invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

Embodiments of the present invention are discussed herein with reference to FIGS. 1-3B. However, those skilled in the art will readily appreciate that the detailed description given herein with respect to these figures is for explanatory purposes as the invention extends beyond these limited embodiments.

Figure 1:
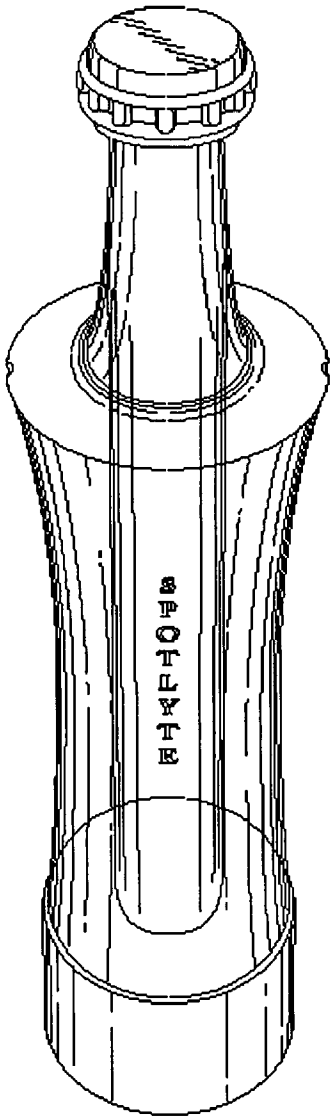
FIG. 1 shows a perspective view of a bottle set designed in accordance with one embodiment of the present invention.

FIG. 1 shows a perspective view of a bottle set 100 designed in accordance with one embodiment of the present invention. The bottle set 100 includes a wine bottle 102, a base 104 and a fixture 104. In one embodiment, the base 102 facing the bottom of the wine bottle 102 is molded to have a shape fitting nicely with the exterior bottom of the wine bottle 102 so that the wine bottle 102 is comfortably sitting on the base 102. In another embodiment, the wine bottle 102 is bonded together with the base 104 using a type of adhesive.

The fixture 104 is vertically disposed within the wine bottle 102, preferably in the center therein. In one embodiment, the fixture 104 is extended between the interior bottom of the wine bottle 102 and the neck of the wine bottle 102. In another embodiment, one end of the fixture 104 is bonded to the interior bottom of the wine bottle 102 and the other end of the fixture 104 is extended to the neck of the wine bottle 102 where it meets a cork used to seal the bottle 102. In still another embodiment, the fixture 104 is extended all the way to the opening of the bottle 102. One of the features in the present invention is to shine marks (e.g., brand names) imprinted on the fixture 104 using guided illumination from the base 104. Depending on implementation, the marks may be a brand name and/or type of wine. A display of a bottle set in accordance with the present invention will make the product in the bottle set stand out among all other displays, attracting sufficient attention from consumers.

Figures 2A, 2B:
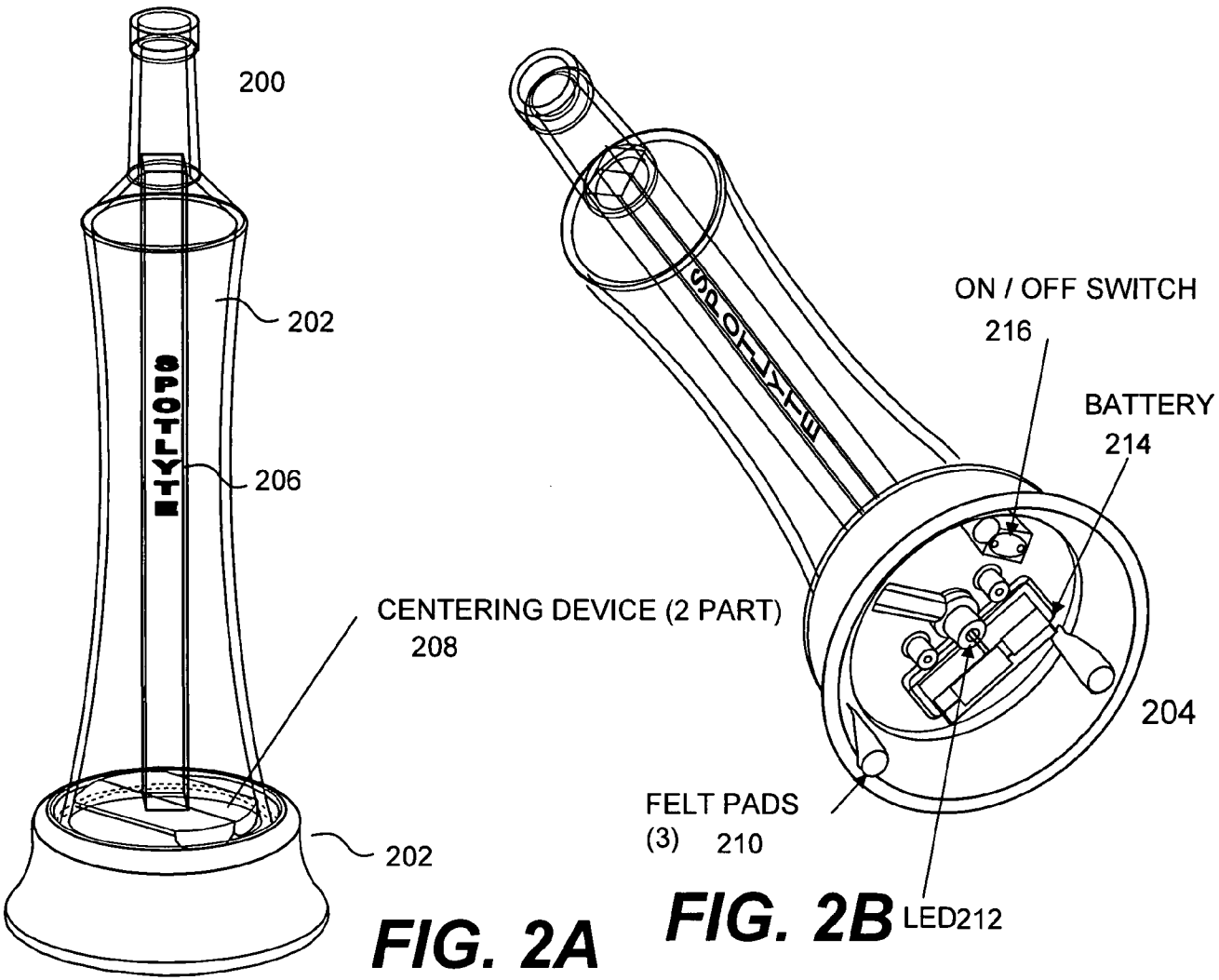
FIG. 2A shows a wine bottle set including a bottle sitting on a base, wherein a fixture carrying a brand name is disposed within the bottle.
FIG. 2B shows an exposed view of a base used in FIG. 2A.

FIG. 2A shows a wine bottle set 200 including a bottle 202 sitting on a base 204, wherein a fixture 206 carrying a brand name is disposed within the bottle 202. The fixture 206 includes a light guide that collects illumination from the base 204 and guides the illumination along the light guide, so as to shine the brand name imprinted on the fixture 206. In one embodiment, the fixture 206 is positioned in a central position of the bottle 202 by a centering device 208 including two pieces to ensure that the fixture 206 does not move.

FIG. 2B shows an exposed view of the base 204. The base itself may be made of a solid material (e.g., a rigid plastic material or stone). The base 204 includes at least three felt pads 210 to stabilize the standing of the bottle set 200 on a flat surface. The base 204 further includes a light source (e.g., an LED) 212, a battery 214 to energize the light source 212, a switch 216 to switch on or off the light source 212. In another embodiment, the base 204 may also include a timer that may automatically turn off the light source 212 after a predefined period (e.g., 4 hours).

Figure 2C:
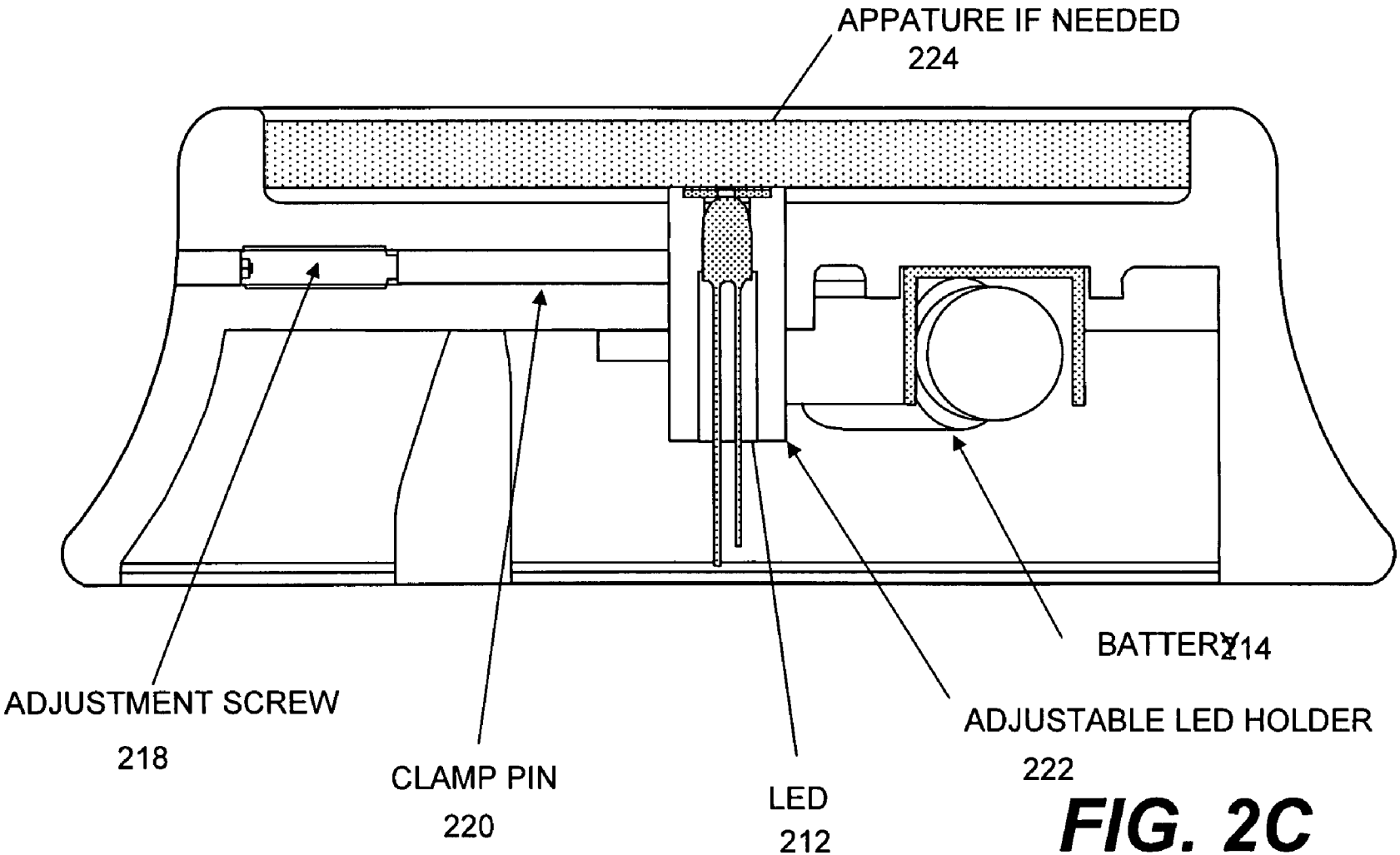
FIG. 2C shows a cross-section view of the base used in FIG. 2A.

FIG. 2C shows a cross-section view of the base 204. After the fixture 206 is positioned in the bottle 202, an adjustment means is provided to ensure that the light source (LED) 212 is aligned with the light guide. In one embodiment, the adjustment means includes an adjustment screw 210 that may be adjusted in or out to push a clamp pin 220 that in return adjusts the position of an adjustable LED holder 222. In one embodiment, an aperture or lens 224 may be used to focus lighting from the LED 212 onto the light guide in the bottle 202. In one embodiment, the base 204 is so designed to appear to be integrated with the bottle 202. With proper decoration or artistic design on the exterior, the base 204 appears to be part of the bottle 202, thus forming an elegant design of a bottle set.

Figure 2D:
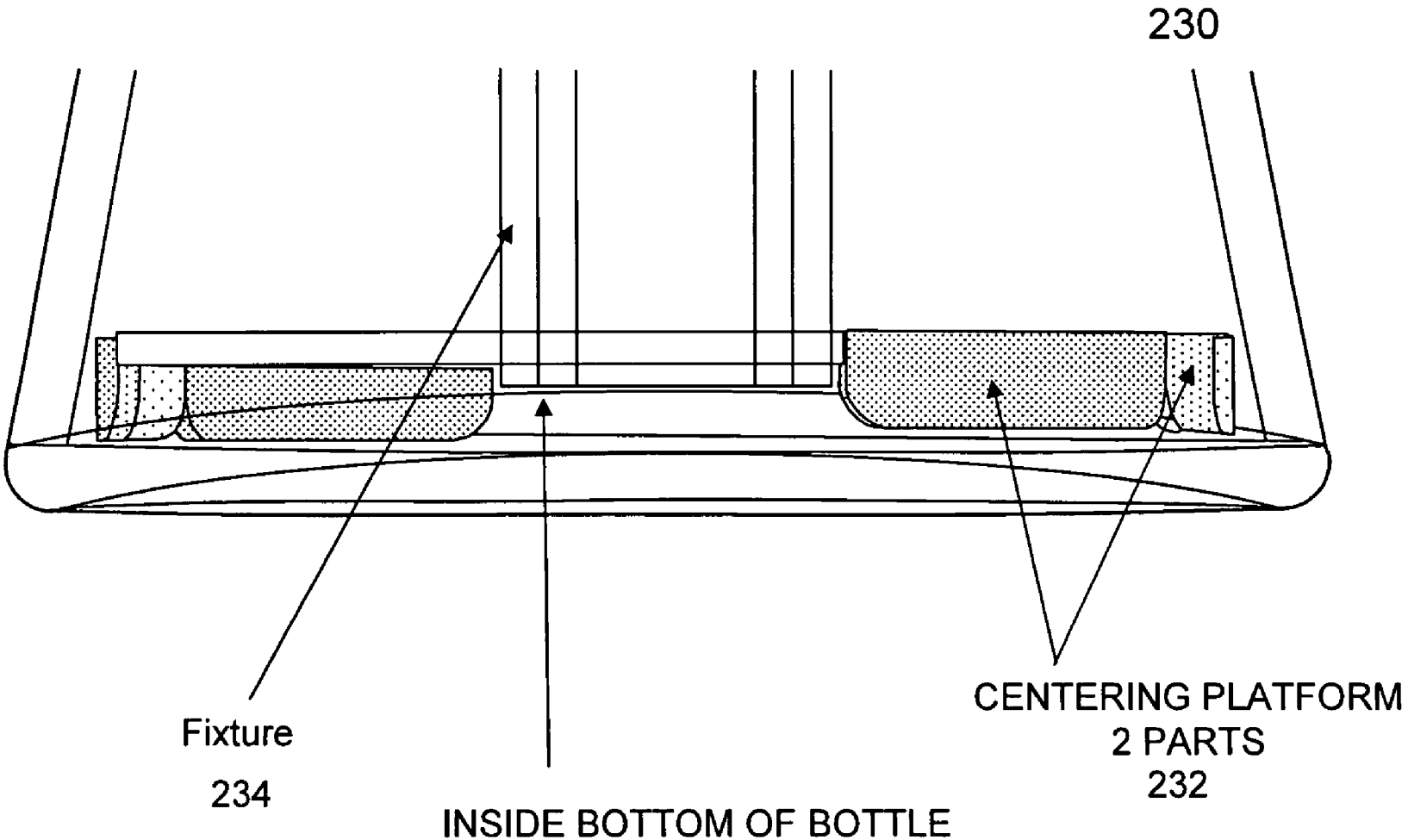
FIG. 2D shows a cross-section view of an interior bottom of a bottle.

FIG. 2D shows a cross-section view of an interior bottom 230 of a bottle. To secure a fixture 234 in the bottom 230 of the bottle, two centering pieces 232 are used to hold the fixture 234 in the middle of the bottom 230 so that lighting from the base can be projected onto the light guide in the fixture 234. The lighting traveling in the light guide subsequently shines or highlights marks on the fixture 234.

Figure 3B:
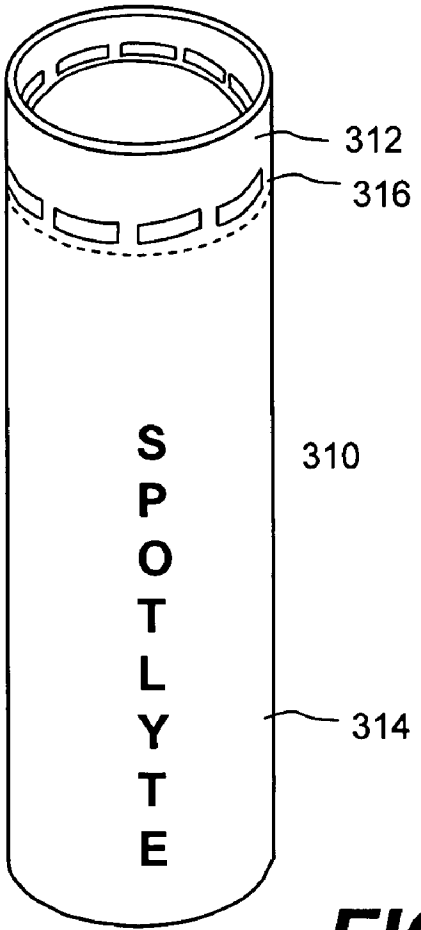
FIG. 3B shows an embodiment of a fixture that is typically used in a situation in which the fixture extends all the way to the neck of a bottle.
Figure 3A:
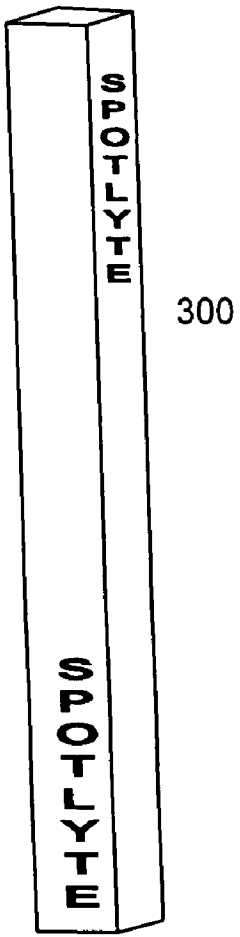
FIG. 3A shows an example of a light guide having a rectangular cross-section.

FIG. 3A shows an example of a light guide 300 having a rectangular cross-section. It should be noted that a triangular or a circular cross-section light guide is also feasible. In one embodiment, marks or brand names are itched into the surfaces of the light guide 300, but are not-overlapping on each side. In other words, the marks do not lie on the same horizontal plane for all sides. To minimize visual distortion through a glass bottle, in one embodiment, the marks on the light guide 300 are pre-distorted in a way that compensates the visual distortion through the glass bottle.

In one embodiment, the light guide 300 is hollow and the marks are on the exterior surface of the light guide 300. The interior surface of the light guide 300 is coated with a type of reflective material so that the light coming into the light guide 300 is fairly evenly distributed to shine the marks. In another embodiment, the light guide 300 is made of a type of mylar film to form an elongated cylinder with a type of paint inside of the cylinder for the light to transmit evenly to all the letters imprinted on the film.

FIG. 3B shows an embodiment of a fixture 310 that is typically used in a situation in which the fixture extends all the way to the neck of a bottle. The fixture 310 includes two parts 312 and 314. The top part 312 is provided to facilitate the flow of liquid while the bottom part 314 is essentially a light guide to guide lighting from a base to illuminate marks on the fixture 310.

Without obstructing the flow of liquid from the opening of the bottle, the top part 312 of the fixture 310 is made hollow. There are openings 316 on the top part 312 of the fixture 310 so that the fluid can flow out of the bottle through the openings 316 without following into the bottom part 314.

The current invention may be implemented in different forms, including a part of a display system, a method and a bottle set. One of the important features in the present invention is to shine marks on a fixture to attract attentions from others on display. It should be noted that two separate words "fixture" and "light guide" are user herein, depending on implementation, they may mean the same thing or two different things (one being included or interested within another).

The present invention has been described in sufficient details with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

We claim:

1. A bottle set comprising:

a base including a light source to provide illumination;

a bottle being fit onto the base; and an elongated fixture disposed in a central position within the bottle, the elongated fixture extended to the base to collect the illumination from the light source in the base to illuminate a mark on the elongated fixture, wherein other parts of the elongated fixture are not being illuminated by the illumination, the elongated fixture being made of a type of mylar film with paint inside the elongated fixture for the illumination to transmit evenly to the marks imprinted on the film, and wherein the light source is an LED positioned coaxially with the fixture so that the illumination from the LED is substantially focused into the elongated fixture in the bottle.

2. The bottle set as recited in claim 1, wherein the base further includes a battery to energize the light source and a switch reachable manually to switch on or off the light source.

3. The bottle set as recited in claim 2, wherein the base further includes a timer that is set to turn off the light source automatically after a predefined period.

4. The bottle set as recited in claim 1, wherein the light source includes at least an LED.

5. The bottle set as recited in claim 4, wherein the base further includes an adjustment pin to adjust the LED to coincide coaxially with the fixture.

6. The bottle set as recited in claim 4, wherein the base further includes at least three pads provided to stabilize the bottle set standing on a flat surface.

7. The bottle set as recited in claim 1, wherein the elongated fixture is made of a type of film to form a cylinder with a type of paint inside of the cylinder for the light to transmit evenly to all the letters imprinted on the film.

8. The bottle set as recited in claim 7, wherein the base is bonded with the bottle.

9. The bottle set as recited in claim 1, wherein the fixture is positioned to be aligned with the light source in the base to receive a maximum amount of the illumination.

10. The bottle set as recited in claim 9, wherein the fixture is positioned by two positioning pieces to ensure that the fixture does not move around.

11. The bottle set as recited in claim 9, wherein the fixture has a cross-section being one of rectangular, square, triangle and round.

12. The bottle set as recited in claim 9, wherein the mark on the fixture is pre-distorted to compensate visual distortion through the bottle.

13. The bottle set as recited in claim 9, wherein the fixture includes a top part that has a number of openings provided to allow fluid to go through so that the fluid can be poured out when the fixture is extended between a bottom of the bottle and a neck of the bottle.

14. The bottle set as recited in claim 1, wherein the mark includes at least two brand names, each of the two brand names being displayed on one side of the fixture, the two brand names are not-overlapping on each side, thus the brand names do not lie on a same horizontal plane for two sides of the fixture.

15. A method for a bottle set including a bottle and a base, the method comprising:

providing a fixture in the bottle, wherein the fixture including a light guide is extended from an interior bottom of the bottle; and sitting the bottle onto the base, wherein the base provides a light source lighting of which is guided through the light guide to illuminate a mark on the fixture, wherein other parts of the fixture are not being illuminated by the lighting, the light source is an LED positioned coaxially with the fixture so that the illumination from the LED is substantially focused into the fixture in the bottle, and wherein the fixture is made of a type of mylar film to form an elongated cylinder with paint inside the elongated cylinder for the lighting to transmit evenly to the mark imprinted on the fixture.

16. The method as recited in claim 15, wherein the base is bonded with the bottle.

17. The method as recited in claim 15, wherein the mark on the fixture is pre-distorted to compensate visual distortion through the bottle.

18. The method as recited in claim 15, wherein the fixture includes a top part that has a number of openings provided to allow fluid to go through so that the fluid can be poured out when the fixture is extended between a bottom of the bottle and a neck of the bottle.

19. The method as recited in claim 15, wherein the fixture includes at least two brand names, each of the two brand names being displayed on one side of the fixture, the two brand names are not-overlapping on each side, thus the brand names do not lie on a same horizontal plane for the two sides.

20. The method as recited in claim 15, wherein the mark includes at least two brand names, each of the two brand names being displayed on one side of the fixture, the two brand names are not-overlapping on each side, thus the brand names do not lie on a same horizontal plane for two sides of the fixture.

* * * * *